US008418949B2

(12) United States Patent
Kadota

(10) Patent No.: US 8,418,949 B2
(45) Date of Patent: Apr. 16, 2013

(54) WEB WINDING METHOD

(75) Inventor: Norihiro Kadota, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 332 days.

(21) Appl. No.: 13/017,653

(22) Filed: Jan. 31, 2011

(65) Prior Publication Data

US 2011/0240790 A1 Oct. 6, 2011

(30) Foreign Application Priority Data

Mar. 30, 2010 (JP) ..... 2010-078976

(51) Int. Cl.
*B65H 18/08* (2006.01)

(52) U.S. Cl.
USPC ..... 242/530.1; 242/541.5; 242/542; 242/547

(58) Field of Classification Search ..... 242/530, 242/530.1, 541, 541.4, 541.5, 541.6, 541.7, 242/542, 542.4, 547
See application file for complete search history.

(56) References Cited

FOREIGN PATENT DOCUMENTS

| | | | |
|---|---|---|---|
| JP | 62-116448 | A | 5/1987 |
| JP | 2678826 | B2 | 11/1997 |
| JP | 2002-265106 | A | 9/2002 |
| JP | 3539786 | B2 | 7/2004 |

*Primary Examiner* — William E Dondero
(74) *Attorney, Agent, or Firm* — Birch, Stewart, Kolasch & Birch, LLP

(57) ABSTRACT

In a web winding method for winding a plurality of cut webs in rolls while pressure is applied thereto from rider rollers, among a web grouping, which is constructed by aligning the plurality of webs in a sideways direction, two or more first divided rider rollers are disposed in a widthwise direction with respect to left end and right end webs, and together therewith, individual second divided rider rollers are disposed with respect to webs apart from the left end web and the right end web, and the plurality of webs are wound.

7 Claims, 8 Drawing Sheets

(Present Embodiment)

(Comparative Example 1)

(Comparative Example 2)

(Comparative Example 3)

WEB WINDING METHOD

CROSS-REFERENCE TO RELATED APPLICATION

This application is based upon and claims the benefit of priority from Japanese Patent Application No. 2010-078976 filed on Mar. 30, 2010, of which the contents are incorporated herein by reference.

BACKGROUND OF THE INVENTION

1. Field of the Invention

The present invention relates to a web winding method for winding a plurality of cut webs into a roll shape while being pressed by rider rollers.

2. Description of the Related Art

Recently, in a method for winding a cut web, taking as an example a surface winding method, a winding core is retained by two long surface drums (drive rollers), and a single rider roller, which is of the same length as the surface drums. While being gripped between the surface drums and the rider roller, when a rotary drive force is applied thereto, a plurality of small-width webs, which are cut by a cutting process and fed, are wound on the winding core. (See, Japanese Laid-Open Patent Publication No. 62-116448.)

In general, a wide raw fabric web has a thickness (thickness variation) that differs in the widthwise direction. For example, per 100 mm in a widthwise direction, a difference in thickness exists on the order of several μm. When a raw fabric web having such thickness variations in the widthwise direction is cut and each of webs, which are small in width, are wound simultaneously, the difference in thickness accumulates, and a variance in the winding diameters of respective webs occurs.

During winding of the webs, in the case that the winding diameters are different between plural webs as noted above, a difference occurs in the pressing force on each of the webs imposed from the surface drums and the rider roller, and as a result, differences can occur in the winding stiffness among each of the webs. In the event that differences in the pressing force are especially large, problems occur in that wrinkles may result in webs for which the winding stiffness is excessively strong, or winding looseness may occur in webs for which the winding stiffness thereof is insufficient.

Consequently, conventionally, the rider roller is divided into a plurality of divided rider rollers, the widthwise dimensions of which are smaller than the width of the cut webs. The respective divided rider rollers are sequentially arranged roughly coaxially at a given gap pitch, which is less than the width of each of the webs, each of the divided rider rollers being moved mutually independently in the pressing direction, whereby the respective webs are pressed thereby (see, for example, Japanese Patent No. 2678826 and Japanese Patent No. 3539786). Owing thereto, because the pressing force of the divided rider rollers with respect to each of the webs is averaged, differences in winding stiffness between respective webs does not occur. Accordingly, even if differences in the winding diameters between each of the webs occur, fear of wrinkles or poor performance due to excessive winding stiffness in a portion of the webs, or winding looseness caused by insufficient winding stiffness, can be eliminated.

Further, as a method for winding a material used for inkjet recording, there is known a method as disclosed in Japanese Laid-Open Patent Publication No. 2002-265106. With this method, the pressing force of a rider roller is regulated so as to reside within a range of from 5 to 40 kg per each one meter web width of the inkjet recording material. In this case, the inkjet recording material can be wound without decreasing the gloss (luster) of the inkjet recording material.

In the methods of Japanese Patent No. 2678826 and Japanese Patent No. 3539786, from the fact that a plurality of divided rider rollers are arranged with respect to a single web, when directed to winding of an inkjet recording material for example, if the pressing force of the divided rider rollers simply is increased, within the surface of the web, recesses occur at portions where the divided rider rollers press against the web, and boundaries (planar unevenness) with portions that are not pressed occur, which can be recognized by the naked eye. In such a case, the appearance thereof becomes unsatisfactory and the web cannot serve as a product.

Further, in the method of Japanese Laid-Open Patent Publication No. 2002-265106, and similarly in the disclosure of Japanese Laid-Open Patent Publication No. 62-116448, because winding is carried out while the webs are pressed by a single rider roller, when there are thickness variations in the widthwise direction of the raw fabric web, there are problems in that wrinkles in the web or looseness in the web windings tend to occur. In particular, there are further problems in that, at both ends of the web, winding portions become gradually expanded out toward the center, and shifting between the windings (telescopic winding) is generated.

Consequently, although it might be considered as a way of resolving the aforementioned problems to apply the divided rider rollers of Japanese Patent No. 2678826 and Japanese Patent No. 3539786 to the method of Japanese Laid-Open Patent Publication No. 2002-265106, because a large number of divided rider rollers are arranged, due to the fact that the width of the individual divided rider rollers becomes smaller, the pressing force produced thereby increases, and planar unevenness occurs. Further, if the pressing force is decreased in order to avoid such planar unevenness, there is a problem in that shifting between the windings easily occurs. Additionally, because the region of stability (stable operating region) thereof is narrow, there is a concern that manufacturability is decreased.

SUMMARY OF THE INVENTION

The present invention has been devised taking into consideration the foregoing types of problems, and has the object of providing a web winding method in which, even if there is unevenness in thickness in a widthwise direction of the raw fabric web, wrinkles, winding looseness, shifting in the windings and planar unevenness, etc., do not occur, and deterioration in manufacturability can be suppressed.

According to the present invention, a web winding method is provided for winding a plurality of cut webs in a rolled form while applying pressure thereto by rider rollers, wherein among a web grouping, which is constructed by aligning the plurality of webs in a sideways direction, at least with respect to webs that are positioned at opposite ends of the web grouping, two or more first divided rider rollers are disposed in a widthwise direction of each of the webs, and together therewith, respective individual second divided rider rollers are disposed with respect to webs apart from the webs positioned at the opposite ends, and the plurality of webs is wound.

In the present invention, a width of the first divided rider rollers is 15 to 200 mm, and a pressing force of the first divided rider rollers is 0.5 to 6 kgf per each roller.

In the present invention, the first divided rider rollers and the second divided rider rollers have a rubber hardness degree of 30° to 50°.

In the present invention, divided rider rollers on which a rounding chamfering process is implemented on end surfaces thereof are used at least as the first divided rider rollers.

In the present invention, among the web grouping, a pressing force per meter in a widthwise direction by one or more of the first divided rider rollers, which is arranged corresponding to a first portion across a widthwise center from a left end of a left end web, and among the web grouping, a pressing force per meter in a widthwise direction by one or more of the first divided rider rollers, which is arranged corresponding to a first portion across a widthwise center from a right end of a right end web, are 30 kgf/m or less respectively upon winding of the plurality of webs.

In the present invention, within the left end web, a pressing force per meter in a widthwise direction at one or more of the first divided rider rollers, which is arranged corresponding to a second portion apart from the first portion, and within the right end web, a pressing force per meter in a widthwise direction at one or more of the first divided rider rollers, which is arranged corresponding to a second portion apart from the first portion, are 30 kgf/m or less upon winding of the plurality of webs.

In the present invention, the webs comprise an inkjet recording material.

In accordance with the web winding method of the present invention, as described above, even if there is unevenness in thickness in a widthwise direction of the raw fabric web, wrinkles, winding looseness, shifting in the windings and planar unevenness, etc., do not occur, and deterioration in manufacturability can be suppressed.

The above and other objects features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
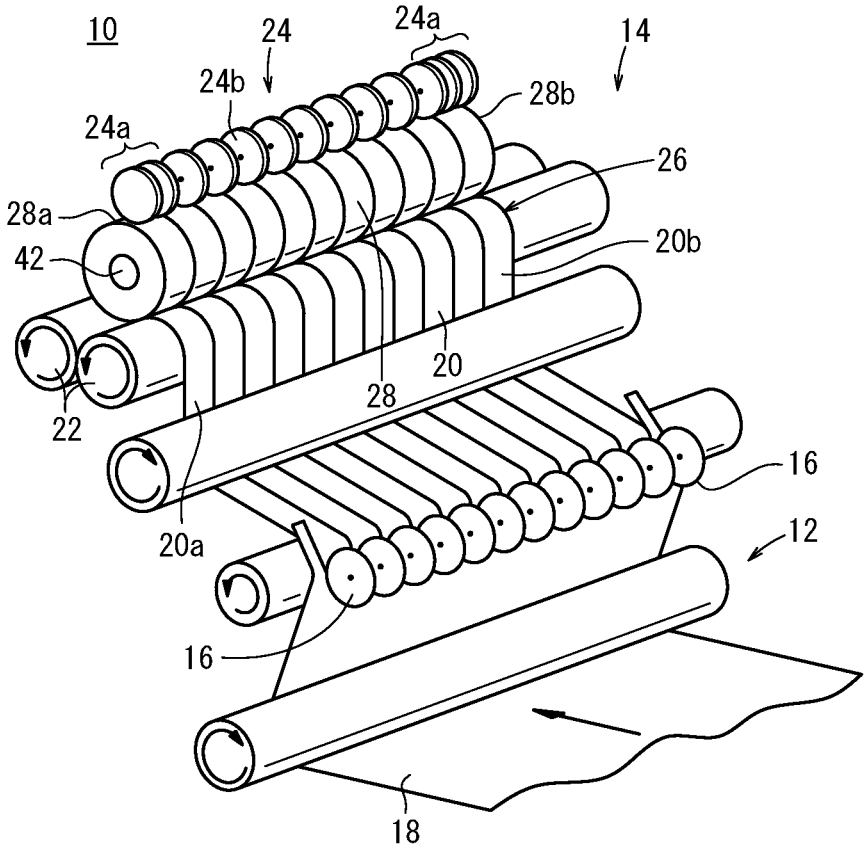
FIG. 1 is a schematic view showing surface winding equipment, which is used by the web winding method according to a present embodiment.

An embodiment to which the winding method according to the present invention, for example, a surface winding method, is applied shall be described below with reference to FIGS. 1 through 8. In the present specification, numerical values at the beginning and end of dashes ("-") indicative of numerical value ranges are used with the meaning of including upper limit and lower limit values of such ranges.

To carry out the web winding method according to the present embodiment, surface winding equipment 10 is used in which a cutting apparatus 12 and a winding apparatus 14 are combined.

The cutting apparatus 12 includes a plurality of cutters 16 arranged in one direction, which cut a wide web (raw fabric web 18) that is fed out from an unillustrated raw fabric roll into a plurality of narrow webs 20.

The raw fabric web 18 and the webs 20 are recording sheets used for inkjet printing, comprising a supporting material body, and an ink accommodating layer containing inorganic particles and a water-soluble metallic compound disposed on the supporting material body.

The inorganic particles may be made up, for example, from particulate silica, colloidal silica, titanium dioxide, barium sulfate, calcium silicate, zeolite, kaolinite, halloysite, mica, talc, calcium carbonate, magnesium carbonate, calcium sulfate, pseudo-boehmite, zinc oxide, zinc hydroxide, alumina, aluminum silicate, calcium silicate, magnesium silicate, zirconium oxide, zirconium hydroxide, cerium oxide, lanthanum oxide, yttrium oxide, and the like. Among such materials, from the standpoint of being formed with a favorable porous structure, particulate silica, colloidal silica, alumina or pseudo-boehmite are preferred.

As the water-soluble metallic compound, there may be used a metallic water soluble salt selected, for example, from calcium, barium, manganese, copper, cobalt, nickel, aluminum, iron, zinc, zirconium, chrome, tungsten and molybdenum.

From a standpoint of improving the gloss (luster) of the ink accommodating layer, among the ink accommodating layers that are disposed on the supporting material body, the uppermost layer, which is separated farthest from the supporting material body, preferably contains colloidal silica. Below, the uppermost layer containing colloidal silica therein shall be referred to as a "colloidal silica layer."

The layer thickness of the ink containing layer is preferably 10-50 μm, and more preferably, 20-40 μm. The layer thickness of the colloidal silica layer, from the standpoint of ink absorption and gloss, is preferably 0.05-5 μm, and more preferably, 0.1-3 μm.

The winding apparatus 14 shown in FIG. 1 comprises two long surface drums 22 that extend mutually in parallel, and divided rider rollers 24, which are arranged along the axial direction of the surface drums 22 and at positions above the two surface drums 22. In particular, within a web grouping 26 made up by aligning a plurality of webs 20 in a sideways direction, two or more first divided rider rollers 24*a* are disposed respectively in a width direction of a left end web 20*a* and a right end web 20*b*, with respect to the left end web 20*a* (or a left end roll 28*a* that is formed upon winding of the left end web 20*a*) and the right end web 20*b* (or a right end roll 28*b* that is formed upon winding of the right end web 20*b*) positioned on opposite ends of the web grouping 26. Further, among the web grouping 26, respective individual second divided rider rollers 24*b* are arranged with respect to webs 20 (or rolls 28 that are formed upon winding of the webs 20) apart from the left end web 20*a* and the right end web 20*b*. In FIG. 1, an example is shown in which two first divided rider rollers 24*a* are arranged respectively in the width direction with respect to the left end web 20*a* and the right end web 20*b*. In cases where the first divided rider roller 24*a* and the second divided rider roller 24*b* need not be distinguished separately, the term "divided rider roller 24" shall be used collectively in reference to both divided rider rollers 24*a*, 24*b*.

Figure 2:
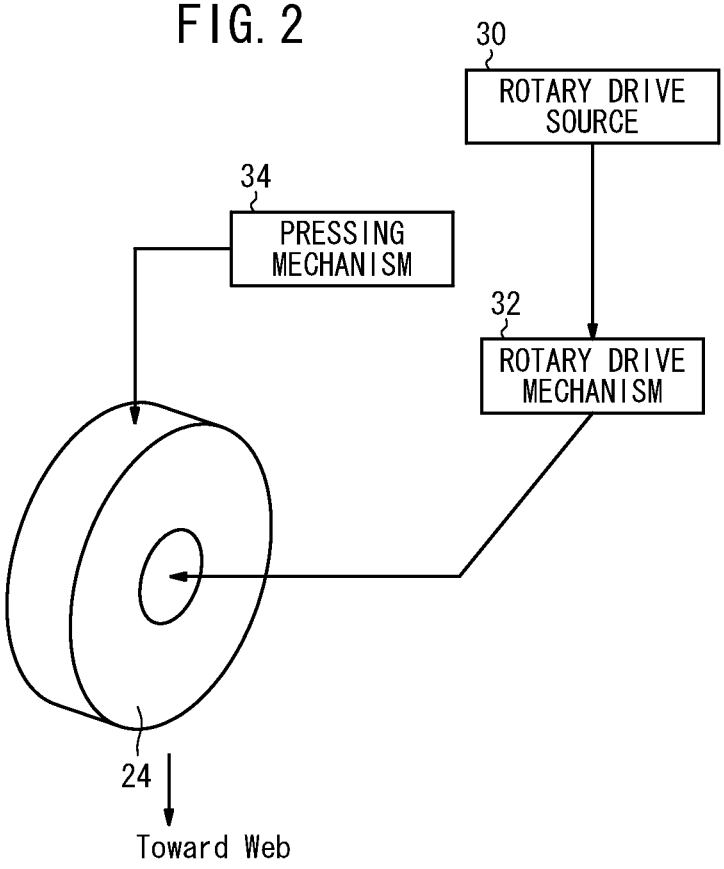
FIG. 2 is an explanatory view showing a driving system constituted by a divided rider roller.

The driving system made up of the respective divided rider rollers 24 may have a similar structure to that disclosed in Japanese Patent No. 2678826 and Japanese Patent No. 3539786. As shown in FIG. 2, the driving system comprises a rotary drive mechanism 32, which transmits a rotary driving force from one of the rotary drive sources 30 to a corresponding divided rider roller 24, and a pressing mechanism 34 for pressing the corresponding divided rider roller 24 toward the web 20 (or the roll 28). For details concerning each of such mechanisms, refer to Japanese Patent No. 2678826 and Japanese Patent No. 3539786, the disclosures of which are incorporated herein by reference.

Figure 3:
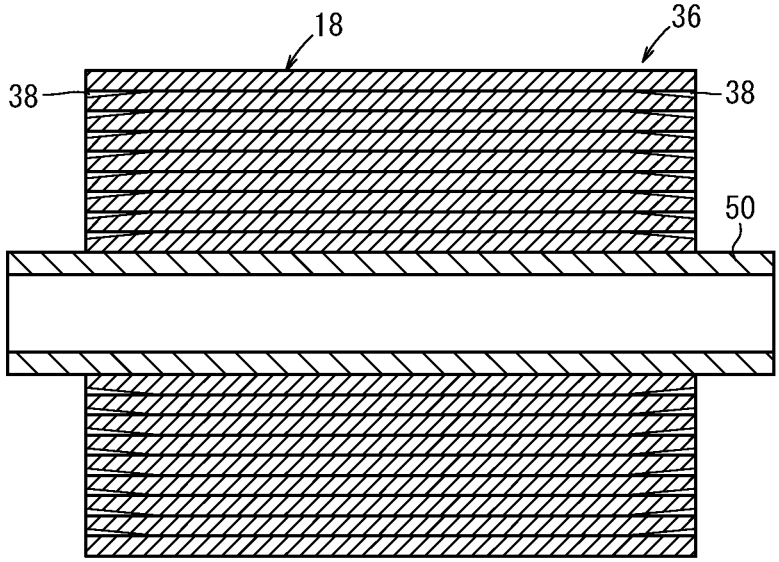
FIG. 3 is a cross sectional view showing a raw fabric roll.
Figure 4:
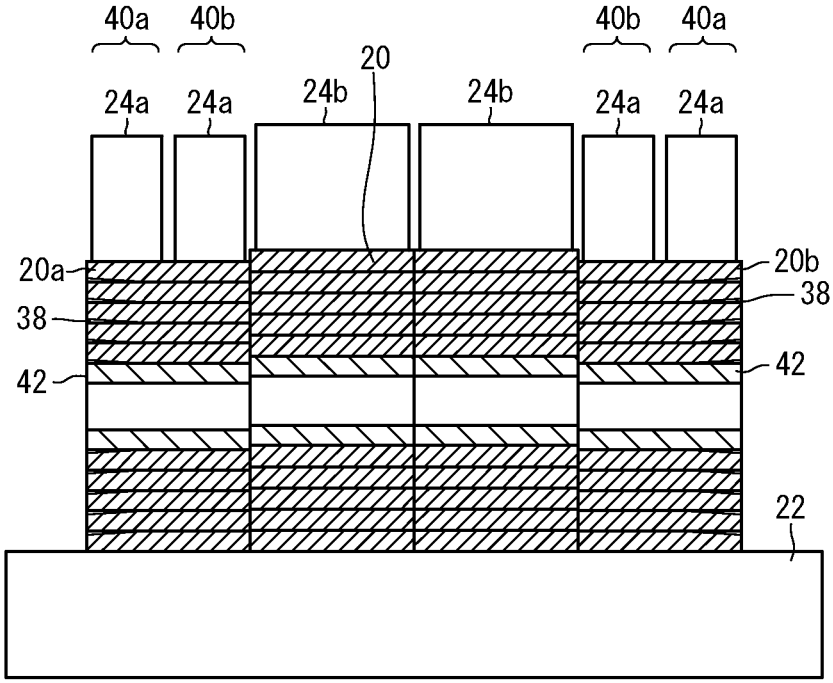
FIG. 4 is an explanatory view showing a partially broken portion (broken roll portion) of the winding method of the present embodiment.

The width of the first divided rider roller 24*a* is 15-200 mm. Respective widths of the plurality of first divided rider rollers 24*a* that are arranged on the left end web 20*a* may be the same or of different widths. For example, as shown in FIG. 3, it often is the case that thickness unevenness 38 exists in the width direction on the raw fabric web 18 that is rolled on the raw fabric roll 36, which is accompanied by, for example as shown in FIG. 4, generation of thickness unevenness 38 at a portion (hereinafter referred to as a "first portion 40*a*") that extends from the left end of the left end web 20*a* to the widthwise center thereof. Within the left end web 20*a*, the portion apart from the first portion 40*a* is referred to as a "second portion 40*b*."

As an example of arranging the first divided rider rollers 24*a*, one of the first divided rider rollers having a width of 200 mm is arranged corresponding to the first portion 40*a* of the left end web 20*a* having a width in excess of 400 mm, whereas in the same manner, one of the first divided rider rollers 24*a* having a width of 200 mm is arranged on the second portion 40*b*. In this case, a total of two first divided rider rollers 24*a* are disposed with respect to the left end web 20*a*.

As other examples, two of the first divided rider rollers 24*a* having a width of 100 mm may be arranged corresponding to the first portion 40*a*, whereas one of the first divided rider rollers 24*a* having a width of 200 mm may be arranged on the second portion 40*b*, or alternatively, a first divided rider roller 24*a* having a width of 150 mm and a first divided rider roller 24*a* having a width of 50 mm may be arranged corresponding to the first portion 40*a*, whereas one first divided rider roller 24*a* having a width of 200 mm may be arranged on the second portion 40*b*. Naturally, a plurality of first divided rider rollers 24*a* may also be arranged on the second portion 40*b*.

Additionally, as shown in FIG. 1, the winding apparatus 14 supports a winding core 42 between two surface drums 22 and a plurality of divided rider rollers 24. While the two surface drums 22 and the plurality of divided rider rollers 24 are rotatably driven and the rotary driving force is applied to the winding core 42, a plurality of webs 20 from the cutting apparatus 12 are continuously pressed mutually independently on the winding core 42 by the plurality of divided rider rollers 24 and are wound into a rolled shape on the winding core 42, such that rolls 28 are formed that correspond respectively to the webs 20.

Moreover, in the present embodiment, the plurality of webs 20 are wound under a condition in which the pressing force from the first divided rider rollers 24*a* is 0.5-6 kgf per each roller, while the pressing force per unit length in the widthwise direction at the divided rider rollers 24 is kept constant.

Consequently, even if there are thickness irregularities in the widthwise direction of the raw fabric web 18, the occurrence of wrinkles, winding looseness, shifting in the windings, and planar unevenness can be suppressed.

The divided rider rollers 24 preferably have a rubber hardness degree of 30° to 50°. If the rubber hardness degree is too low, the divided rider rollers 24 contact the webs 20 too closely and the coefficient of dynamic friction increases, leading to a concern that rotary movement of the webs 20 will be obstructed. In contrast, if the rubber hardness degree is too high, then there is a concern that the webs may become deformed and decrease in luster, and planar unevenness may occur.

Further, preferably, a rounding chamfering process is implemented on end surfaces of the divided rider rollers 24. In this case, the radius of the rounded surface is 2 mm or greater. Owing thereto, the occurrence of planar unevenness can be suppressed. The upper limit of the radius of the rounded surface depends on the width of the divided rider rollers 24, for example, if the width is 15 mm the radius is 3 mm, if the width is 20-50 mm the radius is 4 mm, if the width is 60-100 mm the radius is 5 mm, if the width is 110-150 mm the radius is 6 mm, and if the width is 160-200 mm the radius is 7 mm.

Example

Below, the present invention shall be described in greater detail with reference to preferred embodiments of the present invention. Materials, usage amounts, percentages, process contents, process steps and the like, which are indicated in the embodiments below, can be suitably modified without deviating from the essential gist of the present invention. Accordingly, the scope of the present invention should not be interpreted as being limited by the specific examples described below.

First Embodiment

The condition of occurrence of wrinkles, winding looseness, shifting in windings, and planar unevenness was confirmed in relation to the present embodiment as well as comparative examples 1 through 3.

The Embodiment

An ink accommodating layer was coated and dried on a 650 mm wide, 230 μm thick support body, and as shown in FIG. 3, the raw fabric web 18 was wound in a roll shape on a raw fabric core 50, thereby producing the raw fabric roll 36. At this time, thickness unevenness 38, which occurred in the raw fabric web 18, was on the order of roughly 75 mm respectively from the left end and the right end. Thereafter, the raw fabric web 18, which was fed out from the raw fabric roll 36, was cut into four webs 20 of 150 mm in width by the cutting apparatus 12 of the surface winding equipment 10, which was similar to that shown in FIG. 1. The four webs 20 were wound onto respective corresponding winding cores 42 at a winding length of 100 m (winding length=100 m) and a winding speed of 300 m/minute (winding speed=300 m/minute), thereby producing the four rolls 28 as shown in FIG. 4.

In particular, in the present embodiment, as shown in FIG. 4, two first divided rider rollers 24*a* of the same width (one corresponding to the first portion 40*a* and one corresponding to the second portion 40*b*) are disposed respectively in the width direction of the left end web 20*a* and the right end web 20*b*. Further, individual second divided rider rollers 24*b* are arranged respectively with respect to the webs 20 apart from the left end web 20*a* and the right end web 20*b*.

The width of the first divided rider rollers 24*a* was set at 65 mm. At the left end web 20*a*, the left end of one individual first divided rider roller 24*a* was arranged at a point 5 mm from the left end thereof, while the left end of the second individual first divided rider roller 24*a* was arranged at a point 10 mm from the right end of the one first divided rider roller 24*a*. Similarly, at the right end web 20*b*, the right end of the one individual first divided rider roller 24*a* was arranged at a point 5 mm from the right end thereof, while the right end of the second individual first divided rider roller 24*a* was arranged at a point 10 mm from the left end of the one first divided rider roller 24*a*.

The width of the second divided rider rollers 24*b* was set at 140 mm. The second divided rider rollers 24*b* were arranged such that, at each of the webs 20, both sides of the webs 20 protruded therefrom by roughly 5 mm.

The pressing force from each of the first divided rider rollers 24*a* was 1.5 kgf per each roller, and the pressing force per unit meter by each of the first divided rider rollers 24*a* was 23 kgf/m. The pressing force from each of the second divided rider rollers 24*b* was 3 kgf per each roller, and the pressing force per unit meter by each of the second divided rider rollers 24*b* was 21 kgf/m.

Comparative Example 1

Figure 5:
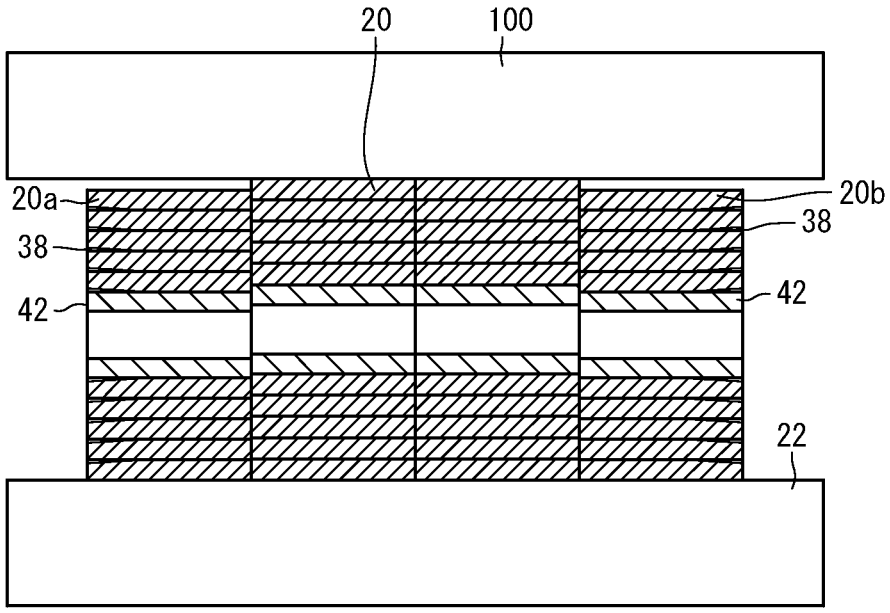
FIG. 5 is an explanatory view showing a partially broken portion (broken roll portion) of a winding method of a first comparative example.

As shown in FIG. 5, one rider roller 100 having a length similar to that of the surface drums 22 was used. The pressing force per unit meter by the rider roller 100 was set at 30 kgf/m. Apart therefrom, winding of the four webs 20 was carried out in a similar manner as in the present embodiment described above.

Comparative Example 2

Figure 6:
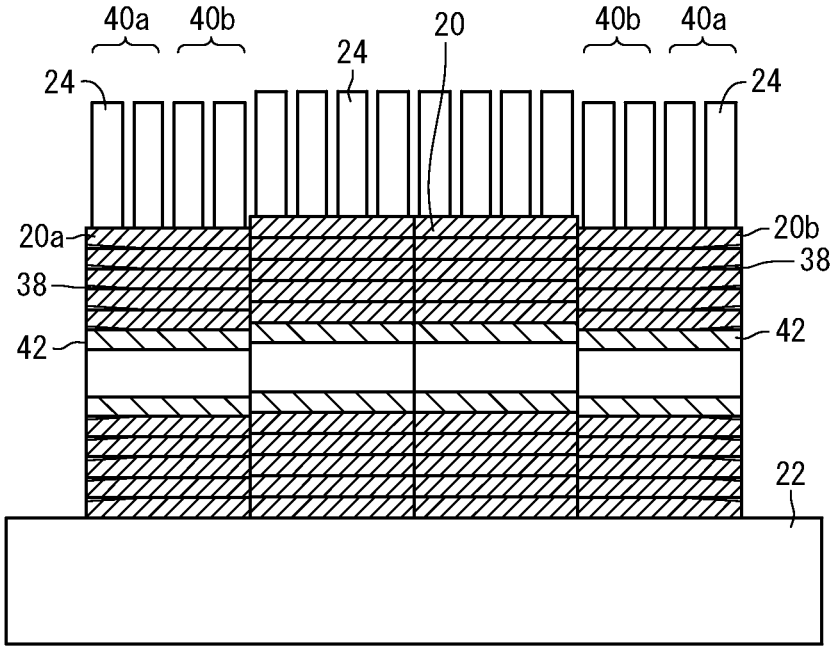
FIG. 6 is an explanatory view showing a partially broken portion (broken roll portion) of a winding method of a second comparative example.

As shown in FIG. 6, four respective divided rider rollers 24 were arranged with respect to each of the webs 20. The pressing force from each of the divided rider rollers 24 was 1.0 kgf per each roller. Apart therefrom, winding of the four webs 20 was carried out in a similar manner as in the present embodiment described above.

The width of each of the divided rider rollers 24 was set at 25 mm. In addition, at each of the webs, the left end of the first divided rider roller 24 was positioned at a point 5 mm from the left end of each of the webs 20, while the right end of the fourth divided rider roller 24 was positioned at a point 5 mm from the right end of each of the webs 20, and gaps of 10 mm were disposed respectively between each of the divided rider rollers 24.

Comparative Example 3

Figure 7:
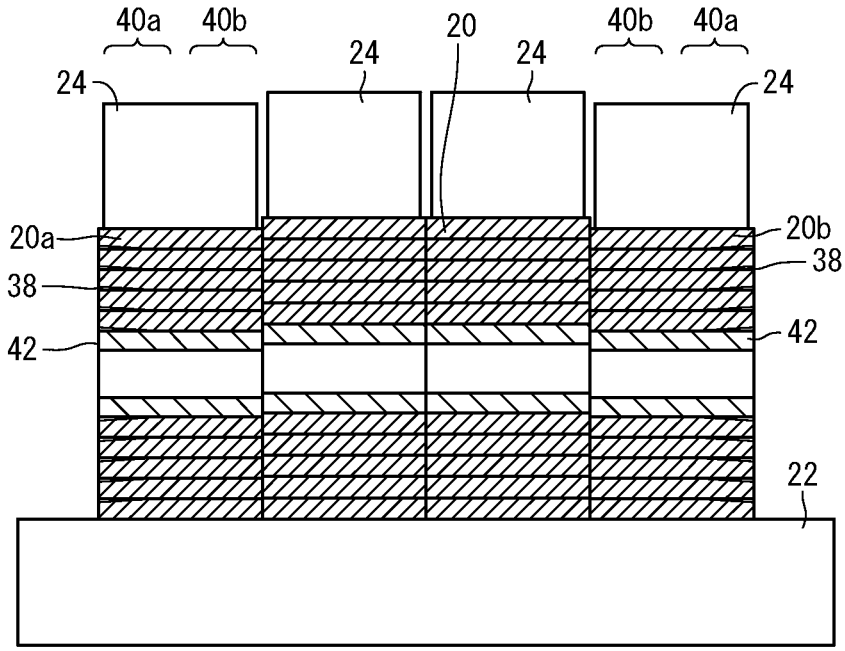
FIG. 7 is an explanatory view showing a partially broken portion (broken roll portion) of a winding method of a third comparative example.

As shown in FIG. 7, individual divided rider rollers 24 were arranged one each with respect to each of the webs 20. The pressing force from each of the divided rider rollers 24 was 3.0 kgf per each roller. Apart therefrom, winding of the four webs 20 was carried out in a similar manner as in the present embodiment described above. The width of the divided rider rollers 24 was set at 140 mm. In addition, the divided rider rollers 24 were positioned such that, at each of the webs 20, both sides of the webs 20 protruded therefrom by roughly 5 mm.

Evaluation

Among the four rolls 28, following winding thereof, the left end roll 28*a* on which the left end web 20*a* was wound and the right end roll 28*b* on which the right end web 20*b* was wound were extracted, and it was confirmed respectively using the naked eye whether or not winding looseness had occurred in the left end roll 28*a* and the right end roll 28*b*, whether or not wrinkles and planar unevenness had occurred in each of the surfaces thereof, and further, whether or not shifting in the windings had occurred respectively at the left end of the left end roll 28*a* and at the right end of the right end roll 28*b*.

Evaluation Results

In the first comparative example, there was winding looseness in the left end roll 28*a* and in the right end roll 28*b*, and it was understood that the winding condition was unsuitable. Further, in each of the surfaces, wrinkles occurred caused by winding looseness. Planar unevenness due to use of the divided rider rollers 24 was not confirmed.

In the second comparative example, although winding looseness was not exhibited in the left end roll 28*a* and the right end roll 28*b*, planar unevenness occurred in each of the surfaces. From the fact that pressure was applied with respect to each of the webs 20 by the divided rider rollers 24 each having a width of 25 mm, it can be considered that the surface pressure was strongly increased, and planar unevenness occurred to a degree discernable by the naked eye. Shifting in the windings was not confirmed.

In the third comparative example, winding looseness did not occur in the left end roll 28*a* and the right end roll 28*b*, and neither wrinkles nor planar unevenness was confirmed. However, it was confirmed that shifting in the windings on the order of 1 mm and greater had occurred.

The Embodiment

In the present embodiment, winding looseness did not occur in the left end roll 28*a* and the right end roll 28*b*, and wrinkles and planar unevenness in each of the surfaces was not confirmed. Further, shifting in the windings was not confirmed.

Second Embodiment

Next, winding of webs 20 was carried out using the same method as in the aforementioned first embodiment, and the relationship between widths of the first divided rider rollers 24*a* corresponding to the first portions 40*a*, the pressing force per each roller, the pressing force per meter in the width direction caused thereby, and the occurrence of planar unevenness and shifting in the windings was confirmed. The results of this study are shown in FIG. 8.

Figure 8:
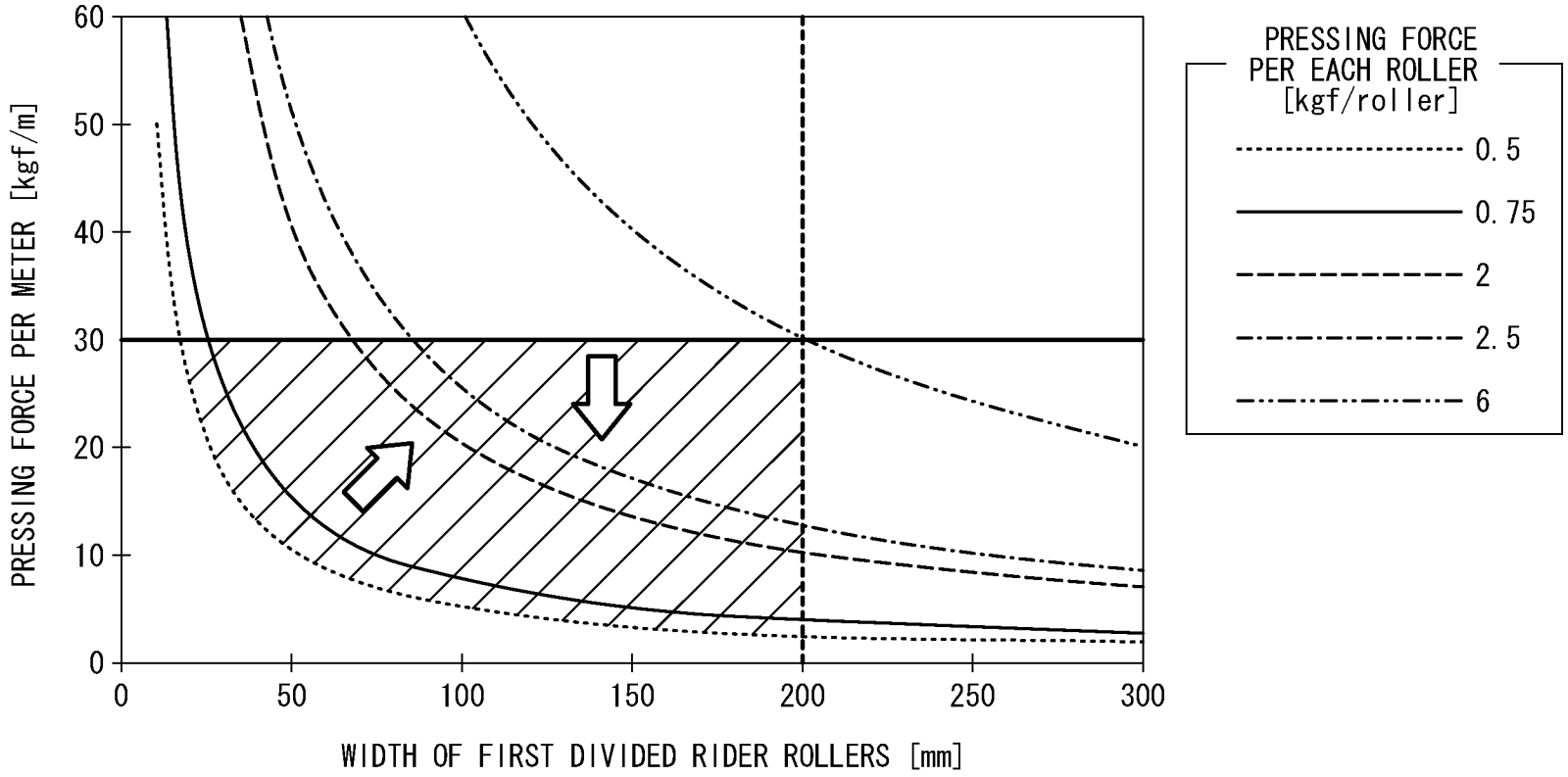
FIG. 8 is a graph showing a relationship between width, pressing force per each roller, pressing force per meter, shifting in the windings, and planar unevenness, of a first divided rider roller, which is arranged corresponding to a first portion.

In FIG. 8, concerning the widths of the first divided rider rollers 24*a*, the width of individual first divided rider rollers 24*a*, which were disposed corresponding to each of the first portions 40*a* of the left end web 20*a* and the right end web 20*b*, is shown. In the same manner as the aforementioned embodiment, only one individual first divided rider roller 24*a*, which was arranged with respect to the first portions 40*a*, was provided. Further, the pressing force per each roller was set successively at 0.25, 0.50, 0.75, 2.00, 2.50, and 6.00 kfg. Although results of the 0.25 kgf trial are not shown, because the pressing force was excessively small, during winding of the webs 20, the first divided rider roller 24*a* tended to bounce, and it became clear that shifting in the windings occurred. The rotary force (torque) transmitted to the individual first divided rider rollers 24*a* arranged corresponding to the first portions 40*a* was 4.8 kfg·cm or greater.

Evaluation

It was understood that planar unevenness was generated at a stage in which the pressing force per meter exceeded 30 kgf/m. Accordingly, it was understood that the number and the pressing force per each roller should be determined within a range in which the pressing force per meter of the first divided rider rollers 24*a* arranged at the first portions 40*a* is 30 kgf/m or less.

Herein, when examples are shown of arranging the first divided rider rollers 24*a* with respect to the first portions 40*a* having a width, for example, in excess of 200 mm, the following conditions result.

(a) An individual first divided rider roller 24*a* having a width of 200 mm is arranged (as discussed above). In this case, the pressing force per each individual roller can be selected arbitrarily from within a range of 0.5-6 kgf per each roller.

(b) Two first divided rider rollers 24*a* having a width of 100 mm are arranged (as discussed above). In this case, the pressing force per each individual roller can be selected arbitrarily from within a range of 0.5-3 kgf per each roller.

(c) An individual first divided rider roller 24*a* having a width of 150 mm is arranged. In this case, the pressing force per each individual roller can be selected arbitrarily from within a range of 0.5-4.5 kgf per each roller.

(d) One first divided rider roller 24*a* having a width of 150 mm and one first divided rider roller 24*a* having a width of 50 mm are arranged. In this case, the pressing force per each individual roller can be selected from within a range of 0.5-4.5 kgf for the first divided rider roller 24*a* having a width of 150 mm, and within a range of 0.5-1.5 kgf for the first divided rider roller 24*a* having a width of 50 mm, and from combinations thereof such that the pressing force per meter by the two first divided rider rollers 24*a* becomes 30 kgf/m.

(e) One first divided rider roller 24*a* having a width of 100 mm and two first divided rider rollers 24*a* having a width of 50 mm are arranged. In this case, the pressing force per each individual roller can be selected from within a range of 0.5-3.0 kgf for the first divided rider roller 24*a* having a width of 100 mm, and within a range of 0.5-1.5 kgf for the first divided rider rollers 24*a* having a width of 50 mm, and from combinations thereof such that the pressing force per meter by the three first divided rider rollers 24*a* becomes 30 kgf/m.

The aforementioned conditions (a) through (e) are shown as examples only. It is a matter of course that various other combinations apart therefrom could be considered.

From the second embodiment, it was understood that if the width of the first divided rider rollers 24*a* is 15-200 mm while the pressing force of the first divided rider rollers 24*a* is 0.5-6 kgf per each roller, then in the left end web 20*a* and the right end web 20*b*, the occurrence of wrinkles, winding looseness, shifting in the windings and planar unevenness can be suppressed. In addition, by setting the pressing force per meter produced by the one or more first divided rider rollers 24*a*, which are arranged corresponding to the first portions 40*a*, to be 30 kgf/m, the occurrence of wrinkles, winding looseness, shifting in the windings and planar unevenness can be further suppressed.

Further, concerning the first divided rider rollers 24*a* that are arranged corresponding to the second portions 40*b* as well, by setting the width thereof to 15-200 mm, the pressing force per each roller to 0.5-6 kgf per each roller, and the pressing force per meter produced by the one or more first divided rider rollers 24*a*, which are arranged corresponding to the second portions 40*b*, to be 30 kgf/m, through cooperation with the first divided rider rollers 24*a* that are arranged corresponding to the first portions 40*a*, the occurrence of wrinkles, winding looseness, shifting in the windings and planar unevenness can be even further suppressed.

Concerning the second divided rider rollers 24*b* that are arranged corresponding to webs 20 apart from the left end web 20*a* and the right end web 20*b* as well, preferably the width thereof is set to 15-200 mm, while the pressing force per each roller is set to 0.5-6 kgf per each roller.

Although certain preferred embodiments of the web winding method according to the present invention have been shown and described in detail, it should be understood that the invention is not limited to the above-described embodiments. It is a matter of course that various modified or additional structures could be adopted therein without deviating from the essence and gist of the present invention.

What is claimed is:

1. A web winding method for winding a plurality of cut webs in a rolled form while applying pressure thereto by rider rollers, wherein among a web grouping, which is constructed by aligning the plurality of webs in a sideways direction, at least with respect to webs that are positioned at opposite ends of the web grouping, disposing two or more first divided rider rollers in a widthwise direction of each of the webs, and together therewith, disposing respective individual second divided rider rollers with respect to webs apart from the webs positioned at the opposite ends, and winding the plurality of webs.

2. The web winding method according to claim 1, wherein, a width of the first divided rider rollers is 15 to 200 mm; and a pressing force of the first divided rider rollers is 0.5 to 6 kgf per each roller.

3. The web winding method according to claim 1, wherein the first divided rider rollers and the second divided rider rollers have a rubber hardness degree of 30° to 50°.

4. The web winding method according to claim 1, wherein divided rider rollers on which a rounding chamfering process is implemented on end surfaces thereof are used at least as the first divided rider rollers.

5. The web winding method according to claim 1, wherein, among the web grouping, a pressing force per meter in a widthwise direction by one or more of the first divided rider rollers, which is arranged corresponding to a first portion across a widthwise center from a left end of a left end web, and among the web grouping, a pressing force per meter in a widthwise direction by one or more of the first divided rider rollers, which is arranged corresponding to a first portion across a widthwise center from a right end of a right end web, are 30 kgf/m respectively upon winding of the plurality of webs.

6. The web winding method according to claim 5, wherein, within the left end web, a pressing force per meter in a widthwise direction at one or more of the first divided rider rollers, which is arranged corresponding to a second portion apart from the first portion, and within the right end web, a pressing force per meter in a widthwise direction at one or more of the first divided rider rollers, which is arranged corresponding to a second portion apart from the first portion, are 30 kgf/m or less upon winding of the plurality of webs.

7. The web winding method according to claim 1, wherein the webs comprise an inkjet recording material.

* * * * *